United States Patent [19]

Honegger

[11] Patent Number: 4,832,273

[45] Date of Patent: May 23, 1989

[54] METHOD OF AND APPARATUS FOR, INTERIM STORING OF PRINTED PRODUCTS, TYPICALLY NEWSPAPERS, PERIODICALS AND THE LIKE, ARRIVING IN AN IMBRICATED PRODUCT FORMATION

[75] Inventor: Werner Honegger, Tann-Rüti, Switzerland

[73] Assignee: Ferag AG, Hinwil, Switzerland

[21] Appl. No.: 5,698

[22] Filed: Jan. 22, 1987

[30] Foreign Application Priority Data

Jan. 27, 1986 [CH] Switzerland ..... 297/86

[51] Int. Cl.[4] ..... B65B 63/04; B65H 29/66

[52] U.S. Cl. ..... 242/59; 242/68.5; 53/118; 53/430

[58] Field of Search ..... 53/118, 430; 242/59, 242/68.5

[56] References Cited

U.S. PATENT DOCUMENTS

| | | | |
|---|---|---|---|
| 4,438,618 | 3/1984 | Honegger | 242/59 X |
| 4,509,703 | 4/1985 | Grunder | 242/59 |
| 4,526,362 | 7/1985 | Thierstein | 242/59 X |
| 4,528,794 | 7/1985 | Thierstein | 53/118 |
| 4,532,750 | 8/1985 | Meier | 242/59 X |
| 4,601,436 | 7/1986 | Honegger | 242/68 X |
| 4,634,070 | 1/1987 | Looper | 242/DIG. 2 |
| 4,641,795 | 2/1987 | Honegger | 242/59 |

FOREIGN PATENT DOCUMENTS

| | | |
|---|---|---|
| 20808 | 12/1976 | Australia . |
| 563840 | 2/1983 | Australia . |
| 23853 | 2/1983 | Australia . |
| 3315496 | 12/1983 | Fed. Rep. of Germany . |

*Primary Examiner*—Stuart S. Levy
*Assistant Examiner*—Katherine Matecki
*Attorney, Agent, or Firm*—Werner W. Kleeman

[57] ABSTRACT

The apparatus contains a winding unit for winding up printed products arriving in an imbricated product formation. The winding unit comprises a hollow substantially cylindrical winding core. Upon the outer surface of the winding core there is wound up a winding band. Prior to the start of a product winding-up operation the winding band is unwound from the winding core and wound upon a spool member. Subsequently the winding band is wound up onto the winding core together with the printed products.

14 Claims, 4 Drawing Sheets

Fig.6
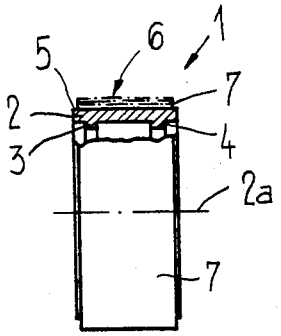
Fig. 8
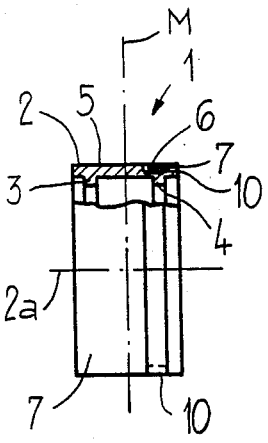
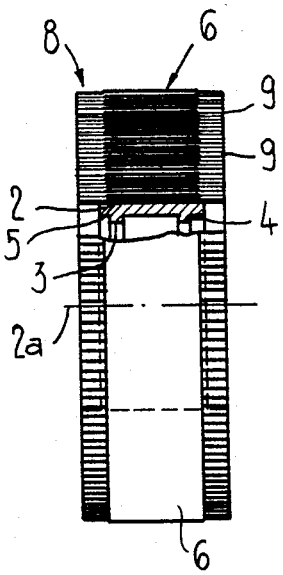
Fig. 7
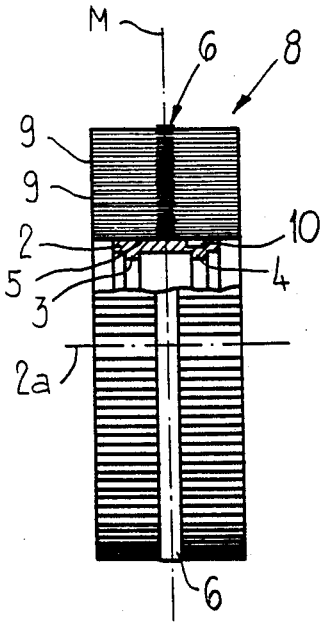
Fig. 9

Fig. 10
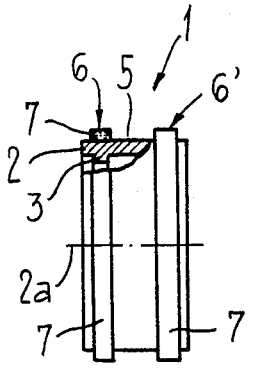
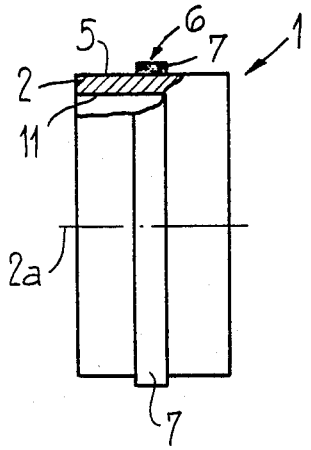
Fig. 12
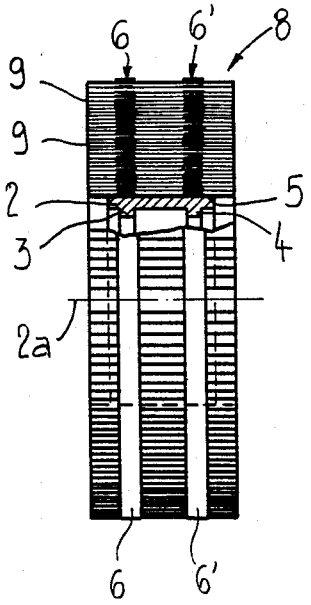
Fig. 11
Fig. 13
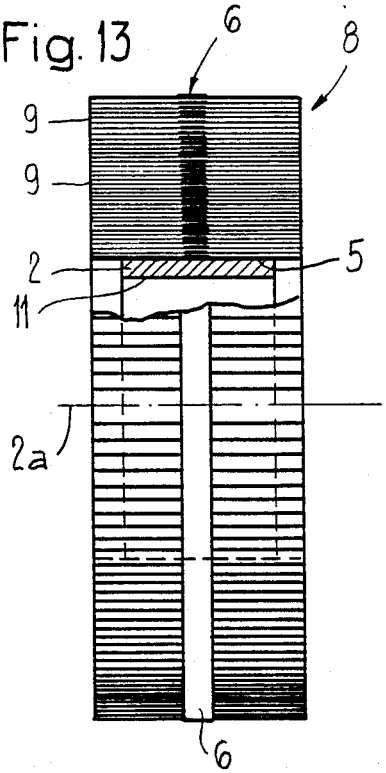

METHOD OF AND APPARATUS FOR, INTERIM STORING OF PRINTED PRODUCTS, TYPICALLY NEWSPAPERS, PERIODICALS AND THE LIKE, ARRIVING IN AN IMBRICATED PRODUCT FORMATION

CROSS-REFERENCE TO RELATED APPLICATION

This application is related to the commonly assigned, copending United States application Ser. No. 07/003,607 filed Jan. 15, 1987, entitled "METHOD AND APPARATUS FOR PROCESSING PRINTED PRODUCTS, SUCH AS NEWSPAPERS, MAGAZINES AND THE LIKE, ARRIVING IN AN IMBRICATED FORMATION AND WOUND PACKAGES PRODUCED THEREBY", now granted as U.S. Pat. No. 4,769,973 on Sept. 13, 1988.

BACKGROUND OF THE INVENTION

The present invention broadly relates to a new and improved method of, and apparatus for, interim or intermediate storing of printed products, in particular, but not exclusively newspapers, periodicals and the like, which arrive in an imbricated product formation.

Generally speaking, the present invention relates to a new and improved method of the type as described and which method entails the step of winding up on a winding core which is rotatably drivable and which has a hollow substantially cylindrical shape, the incoming imbricated product formation conjointly with at least one winding band or tape which is wound up under tension and unwound from a spool member. Prior to the start of the winding-up operation, the winding band or tape is unwound from a winding band supply or package which is carried along with the winding core, and wound up onto the spool member.

In a winding unit as known, for example, from Swiss Pat. No. 652,379 and its cognate U.S. Pat. No. 4,532,750, granted Aug. 6, 1985, the winding core comprises a hollow substantially cylindrical winding body or core upon which the printed products are wound in an imbricated formation. The winding body or core further comprises a supply spool for the winding band or tape and this supply spool is arranged within the interior of the winding body or core. The winding body or core is supported by means of rib members at a shaft which extends through the winding body or core and protrudes or projects therefrom. The supply spool is rotatably mounted at the shaft. Connected to the supply spool and conjointly rotatable therewith is a drive wheel or roll which is also mounted at the shaft. This drive wheel or roll is engageable with a pivotably mounted friction wheel or roll for setting into rotation the supply spool. The winding body or core is provided with a slot through which the winding band can pass which is located in the interior of the winding body or core.

The winding band or tape is always transported and stored conjointly with the winding body or core. Before winding-up printed products, the required or predetermined length of the winding band or tape is unwound from the supply spool and wound up for interim or intermediate storage on the spool member which is arranged externally of the winding body or core. During the winding up operation of the printed products, the winding band or tape is withdrawn from this spool member and wound up on the winding body or core conjointly with the printed products. Any unrequired length of the winding band or tape remains wound up on the supply spool.

As already explained hereinbefore, a slot is provided in order to outwardly pass the winding band or tape from the interior of the winding body or core. In order to outfeed the winding band or tape in the correct direction, i.e. in the direction towards the spool member, the winding body or core first must be turned into a predetermined position in which the slot or exit slot for the winding band or tape assumes the proper position before the outfeeding or unwinding operation of the winding band or tape can be started. This positioning operation of the winding body or core represents a relatively time-consuming operation especially when manually executed and, in the case of automatic positioning, requires a corresponding constructional expenditure.

Furthermore, the construction of the known winding unit is very complicated which increases its manufacturing costs. This is of great significance particularly in the printing industry because there is required a very large number of such winding units. Additionally, this winding unit requires a great deal of space in the direction of the shaft which laterally protrudes from the winding unit.

SUMMARY OF THE INVENTION

Therefore, with the foregoing in mind it is a primary object of the present invention to provide a new and improved method of, and apparatus for, interim storing of printed products, typically newspapers, periodicals and the like, which arrive in an imbricated product formation, and which method and apparatus do not exhibit the aforementioned drawbacks and shortcomings of the prior art.

Another and more specific object of the present invention aims at providing a new and improved method of, and apparatus for, interim storing of printed products, typically newspapers, periodicals and the like, which arrive in an imbricated product formation, and which method and apparatus permit winding-up the printed products on the winding body or core without requiring too extensive preparatory operations.

A still further important object of the present invention is directed to a new and improved method of, and apparatus for, interim storing of printed products, typically newspapers, periodicals and the like, which arrive in an imbricated product formation and which method and apparatus permits using the simplest possible means requiring a minimum of space.

Yet a further significant object of the present invention aims at providing a new and improved apparatus for interim storing of printed products, typically newspapers, periodicals and the like which arrive in an imbricated product formation, and which apparatus is of relatively simple construction and design as well as extremely economical to manufacture and yet affords highly reliable operation thereof without being subject to breakdown and malfunction, and also requires a minimum of maintenance, servicing and space.

Now in order to implement these and still further objects of the present invention which will become more readily apparent as the description proceeds, the method of the present development is manifested by the features that, the winding band or tape is wound up on the outer surface of the winding body or core. Prior to the start of the winding-up operation of the printed products upon the winding body or core, the winding band or tape is unwound from the outer surface of the winding body or core and wound up on the spool member.

As alluded to above, the invention is not only concerned with the aforementioned method aspects, but also relates to a novel construction of apparatus for carrying out this method. Generally speaking, the inventive apparatus comprises a winding unit for interim storing of printed products, typically newspapers, periodicals and the like which arrive in an imbricated formation. The winding unit contains a rotatably driven, hollow substantially cylindrical winding body or core and a spool member containing at least one winding band or tape which is wound up on such spool member. Means are provided for withdrawing the winding band or tape from a winding band or tape supply which is carried along with the winding body or core, and winding the winding band or tape on the spool member prior to the start of a winding up on the rotatably driven winding body or core, the imbricated product formation conjointly with the at least one product winding-up operation. Further means are provided for winding band or tape which is placed under tension and unwound from the aforementioned spool member.

To achieve the aforementioned measures, the inventive apparatus, in its more specific aspects, comprises:

a winding tape or band which is wound-up on the outer surface of the winding body or core; and one end of the winding band or tape is connected with the winding body or core.

Due to the fact that the winding band or tape is wound up on the outer surface of the winding body or core, the winding band or tape can be unwound from the winding body or core without great difficulties and in a simple manner. During this unwinding operation, the winding body or core is readily moved into the proper position for withdrawing the winding band or tape without there being required actual positioning of the winding body or core.

The winding unit comprising the winding body or core and the winding band or tape wound thereupon, is of extremely simple construction since the winding body or core upon which the printed products are wound, simultaneously serves as a support for the winding band or tape. Therefore, a separate spool for the winding band or tape is no longer necessary. Furthermore, there is also not required a shaft which is fixedly connected to the winding body or core and thus the winding unit can be manufactured at favorable costs. Additionally, space-saving stacking of the winding units is now rendered possible regardless of whether such winding unit : is empty or supports a product package.

Due to the necessarily relatively large diameter of the winding body or core, the storage of the predetermined length of winding band or tape at the winding body or core only requires a relatively small number of turns or windings on the winding body or core. The outer diameter of the winding unit including the wound-up winding band or tape thus is only slightly larger than the diameter of the winding body or core. This is particularly true in the case that the winding band or tape is wound up on the winding body or core in turns or windings which are offset from each other in the direction of the lengthwise axis of the winding body or core, in other words in a spirally or helically shaped configuration.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIG. 6 shows a front view, partially in section and similar to FIG. 1, of a winding body or core of a second exemplary embodiment of the inventive winding apparatus and containing a wide or broad winding band or tape;

FIG. 7 is a front view, partially in section and similar to FIG. 3, of the winding body or core shown in FIG. 6 and containing a package of printed products wound thereupon;

FIG. 8 shows a front view, partially in section and similar to FIG. 1, of a winding body or core of a third exemplary embodiment of the inventive winding apparatus and containing a wound-up winding band or tape located in a groove of the winding body or core;

FIG. 9 is a front view, partially in section and similar to FIG. 3, of the winding body or core shown in FIG. 8 and containing a package of printed products wound up thereupon;

FIG. 10 shows a front view, partially in section and similar to FIG. 1, of a winding body or core of a fourth exemplary embodiment of the inventive winding apparatus and containing two winding bands or tapes wound thereupon;

FIG. 11 is a front view, partially in section and similar to FIG. 3, of the winding body or core shown in FIG. 10 and containing a package of printed products wound thereupon;

FIG. 12 shows a front view, partially in section and similar to FIG. 1, of a winding body or core of a fifth embodiment of the inventive winding apparatus and which winding body or core is free of internal rib members;

FIG. 13 is a front view, partially in section and similar to FIG. 3, of the winding body or core shown in FIG. 12 and containing a package of printed products wound thereupon;

DETAILED DESCRIPTION OF THE PREFERRED EMBODIMENTS

Figure 1:
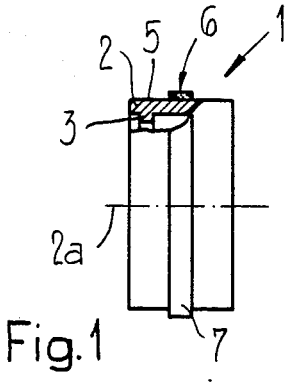
FIG. 1 shows a front view, partially in section, of a winding body or core of a first exemplary embodiment of the inventive winding apparatus and containing a wound-up winding band or tape.
Figure 2:
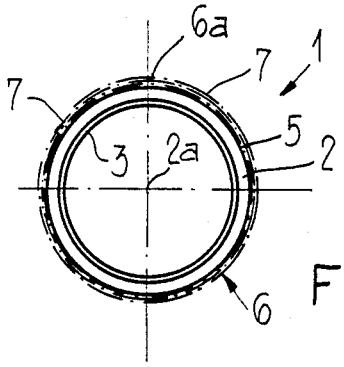
FIG. 2 shows a side view of the winding body or core illustrated in FIG. 1.

Describing now the drawings, it is to be understood that to simplify the showing thereof only enough of the structure of the inventive winding apparatus has been illustrated therein as is needed to enable one skilled in the art to readily understand the underlying principles and concepts of the present invention. Turning now specifically to the drawings, the front and side view of a winding unit 1 is illustrated in FIGS. 1 and 2 by way of example and not limitation. Such winding unit 1 of a first exemplary embodiment of the inventive winding apparatus comprises a hollow, substantially cylindrical winding body or core 2 having a lengthwise axis which is designated by the reference character 2*a*. On the inside the winding body or core 2 is arranged in a spaced relationship to each other and which serve for the handling and support of the winding body or core 2.

On the outer side or outer surface or jacket 5 of the winding body or core 2, there is wound a winding band or tape 6. One end of the winding band or tape 6 is fixedly attached to the winding body or core 2. In this arrangement the individual turns or windings 7 of the winding band or tape 6 lie on top of each other or are superimposed on one another as is particularly evident from FIG. 1. The free end 6*a* of the winding band or tape 6 is releasably connected to the last or outer complete turn or winding 7 in any known suitable manner such as, for example, by means of an adhesive tape or a "VELCRO"-type fastener. This can be attained without difficulties since this free end 6*a* substantially always is positioned at the same circumferential location of the outer surface 5 because the length of the wound-up winding band or tape 6 does not change and the winding band or tape 6 remains attached to the winding body or core 2.

Figure 3:
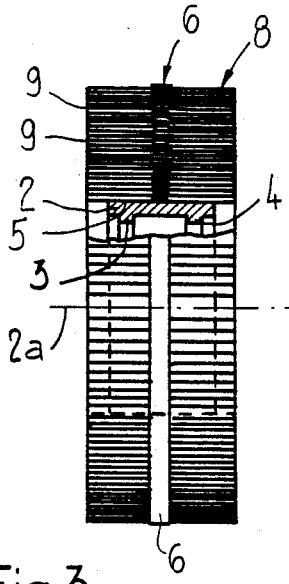
FIG. 3 is a front view, partially in section, of the winding body or core shown in FIG. 1 and containing a package of printed products wound thereupon.
Figure 4:
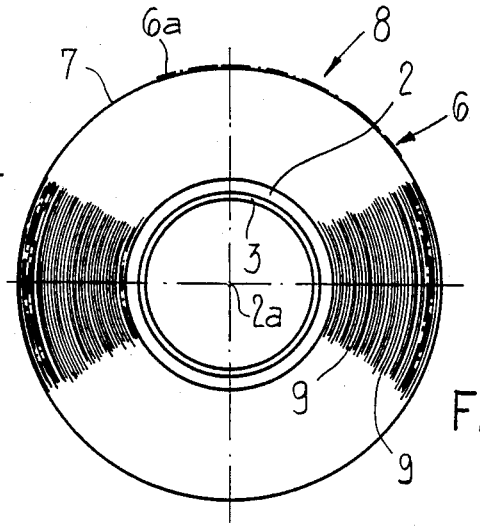
FIG. 4 is a side view of the winding body or core as illustrated in FIG. 3.

In FIGS. 3 and 4 there is respectively illustrated the front view and the side view of a finished or completed product package 8 which has been formed at the winding body or core 2 in a manner still to be described with reference to FIG. 14. This product package 8 is made up of printed products, such as newspapers, periodicals, supplements thereto and the like which are wound up on the winding core 2 in an imbricated product formation. In this wound-up product package 8 the winding band or tape 6 is interposed between the individual layers or coils 9. The free end 6*a* of the winding band or tape 6 is releasably adhered to the outermost complete turn or winding 7 of the winding band or tape 6 as seen in FIG. 4.

Figure 5:
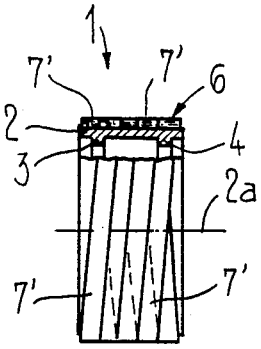
FIG. 5 shows a front view, partially in section, of the winding body or core illustrated in FIG. 1 and containing the winding band or tape in a spirally wound configuration.

Contrary to the mode of winding-up the winding band or tape 6 as shown in FIGS. 1 and 2 and which results in superimposed turns or windings on the winding core 2, it is also possible to wind up the winding band or tape 6 on the outer surface 5 of the winding body or core 2 in a substantially spirally or helically wound configuration as illustrated in FIG. 5. The individual turns or windings 7' are distributed across the entire width or length of the winding body or core 2 in this arrangement. In this manner there is formed a substantially cylindrical outer surface across the entire width or length of the winding body or core 2 which cannot be realized in the construction shown in FIGS. 1 and 2. It is also possible that the winding band or tape 6 is wound up on the winding body or core 2 such that the individual turns or windings 7' overlap each other to a certain extent and do not lie adjacent to one another as illustrated in FIG. 5.

When the winding band or tape 6, as shown in FIG. 5, is wound up such that the turns or windings 7' are laterally offset from one another in the direction of the lengthwise axis 2*a* of the winding body or core 2, this has the advantage that a substantially cylindrical outer surface is formed even when only part of the winding band or tape 6 is unwound from the winding body or core 2.

Further exemplary embodiments of the inventive winding apparatus will now be described with reference to FIGS. 6 to 13 which correspond to FIGS. 1 and 3 in their mode of illustration.

The second exemplary embodiment shown in FIGS. 6 and 7 uses a comparatively wider or broader winding band or tape 6 which is only slightly less broad than the winding body or core 2. This has the advantage that, similar to the construction shown in FIG. 5, the outer surface of the winding unit 1 always remains in a substantially cylindrical shape.

In the third exemplary embodiment of the inventive winding apparatus shown in FIGS. 8 and 9, the winding band or tape 6 which is wound up on the outer surface 5 of the winding body or core 2, is accommodated in a groove 10. This groove 10 is open towards the exterior and extends substantially along the entire circumference of the winding body or core 2. Preferably, this groove 10 is laterally offset with respect to a median plane M extending substantially perpendicular to the lengthwise axis 2*a* of the winding body or core 2. Such a construction has the advantage that the wound-up printed products will not be drawn into the empty groove 10 because the winding band or tape 6 in the product package 8 is located in the region of the aforementioned median plane M and not in the region of the groove 10 as illustrated in FIG. 9.

As can be seen for the fourth exemplary embodiment of the inventive winding apparatus shown in FIGS. 10 and 11, there can also be provided two winding bands or tapes 6 and 6' which are wound-up in approximately parallel relationship on the outer surface 5 of the winding body or core 2. Such construction, however, not only requires more than one winding band or tape 6 but also two devices for winding and unwinding the winding bands or tapes 6 and 6'.

The fifth exemplary embodiment of the inventive winding apparatus shown in FIGS. 12 and 13 corresponds to the first exemplary embodiment shown in FIGS. 1 and 3 except for the construction of the winding body or core 2. Compared to the latter and as shown in FIGS. 12 and 13, the winding body or core 2 does not possess inwardly projecting rib members like the rib members 3 and 4 shown in FIGS. 1 and 3. Instead, the inner surface 11 of the winding body or core 2 constitutes a substantially cylindrical surface extending substantially across the entire width or length of the winding body or core 2. Such construction of the winding body or core 2 enables a simpler and therefore cheaper mode of manufacture.

Figure 14:
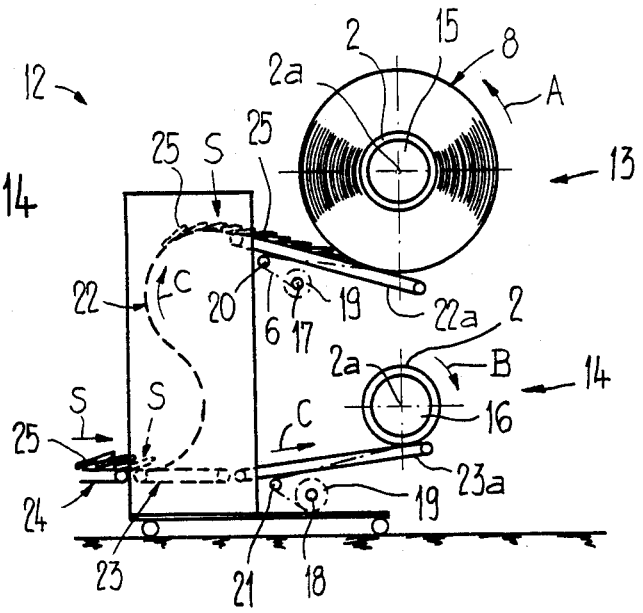
FIG. 14 shows a side view of a winding station and illustrates the winding-up operation in an exemplary embodiment of the inventive method.

With reference to FIG. 14 there will now be explained in more detail the formation of the product packages 8 and the preparatory operation associated therewith in an exemplary embodiment of the inventive method.

FIG. 14 illustrates a mobile winding-up station 12 provided with two winding-up locations or terminals 13 and 14 which are arranged one above the other. At each winding-up location or terminal 13 and 14 there is respectively provided a merely schematically indicated support or supporting structure 15 or 16 for the respective winding body or core 2. There is further associated with each winding-up location or terminal 13 and 14 a respective rotatably mounted spool member 17 or 18 for the winding band or tape 6. The winding band or tape 6 is wound up on the spool members 17 or 18 to form a winding band or tape package 19 in a manner to be more fully described hereinafter. Guide rolls or deflection rolls 20 and 21 for the winding band or tape 6 are placed upstream of the associated spool members 17 and 18.

Infeed conveyors 21 and 23, which are only schematically illustrated, lead to the respective winding-up locations or terminals 13 and 14. End sections 22*a* and 23*a* of the respective infeed conveyors 22 and 23 are constructed as pivotably supported rocker or balance members. The infeed conveyors 22 and 23 are preceded by a common conveyor or conveying device 24 supplying or infeeding the printed products 25 which arrive in the imbricated product formation S and which are intended to be wound-up, and selectively transferring the printed products 25 to one of the conveyors 22 and 23.

In preparation for the winding-up operation carried out upon the supplied imbricated product formation S, a winding body or core 2 containing a winding band or tape 6, which is wound up on the outer surface 5 of the winding body or core 2, is mounted or positioned at the support or supporting structure 15 or 16, as the case may be. Subsequently, the free end 6*a* of the winding band or tape 6 is guided around the respective guide roll 20 or 21 and detachably attached to the associated empty spool member 17 or 18. During this operation the winding body or core 2 which is freely rotatably supported at the support or supporting structure 15 or 16, is automatically rotated into its proper position.

Thereafter the spool member 17 or 18 is driven in a conventional and therefore not particularly illustrated manner. As a consequence, the winding band or tape 6 is unwound from the winding body or core 2 which is rotated in the direction of the arrow B as shown at the lower winding-up location or terminal 14. During this unwinding operation of the winding band or tape 6, the winding body or core 2 is slightly braked by means of a braking device which is of conventional construction and therefore not illustrated. As soon as the required or predetermined length of the winding band or tape 6 has been unwound from the winding body or core 2 and wound up on the spool member 17 or 18, the spool member drive is stopped. The winding body or core 2 is now prepared for receiving the printed products 25.

In order to carry out the subsequent winding-up of the printed products 25, which are supplied by the common feeder or conveyor or conveying device 24 and thus arrive in an imbricated product formation S, the winding body or core 2 is driven for rotation in the direction of the arrow A as illustrated for the upper winding-up location or terminal 13. The winding band or tape 6 which is fixedly connected to the winding body or core 2, is unwound from the winding band or tape package 19 and wound up under tension conjointly with the imbricated product formation S. This operation is conventional and is explained in more detail, for example, in Swiss Pat. No. 642,602 and its cognate U.S. Pat. No. 4,438,618, granted Mar. 27, 1984. At the end of the winding-up operation the winding band or tape 6 is singly or multiply wound around the finished product package 8 in order to prevent such product package 8 from falling apart or unraveling. If desired and as already previously mentioned with reference to FIGS. 3 and 4, the free end 6*a* of the winding band or tape 6 may be detachably attached to the outermost complete turn or winding 7.

The finished product package 8 is now removed from the respective support or supporting structure 15 or 16. Thereupon an empty winding body or core 2 containing a wound-up winding band or tape 6 on the outer surface 5 thereof, is placed at the support or supporting structure 15 or 16, as the case may be.

The unwinding of the printed products 25 will now be explained with reference to FIG. 15.

Figure 15:
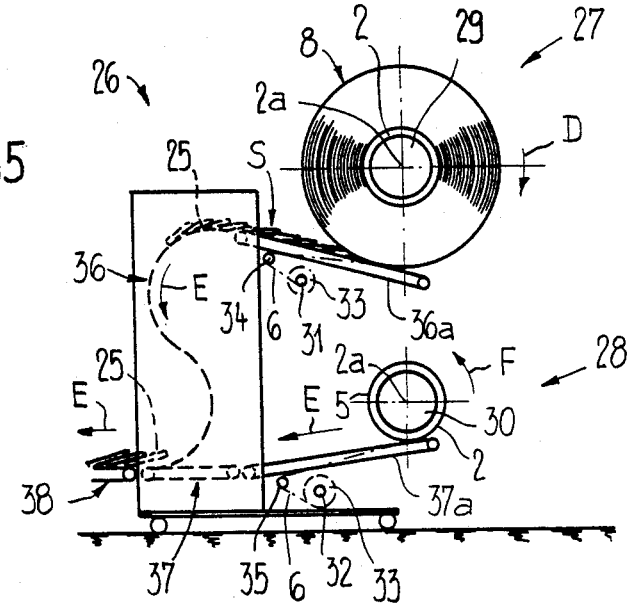
FIG. 15 shows a side view of an unwinding station and illustrates the unwinding operation on a product package formed at the winding station illustrated in FIG. 14.

An unwinding station 26 is shown in FIG. 15 and in principle is of the same construction as the winding-up station 12 shown in FIG. 14. The unwinding station 26 is provided with unwinding locations or terminals 27 and 28 which are placed one above the other and contain supports or supporting structures 29 and 30, respectively, for receiving winding bodies or cores 2. Associated with each unwinding location or terminal 27 or 28 is a spool member 31 or 32 on which the winding band or tape 6 is wound to form a winding band or tape package 33. The winding band or tape 6 is guided or trained around respective guide rolls 34 and 35. In order to remove the unwound printed products 25 from each unwinding location or terminal 27 and 28 there are present two outfeed conveyors 36 and 37 which are of conventional construction and therefore only schematically illustrated and which are followed by a common removing conveyor or conveying device 38. The initial or starting sections 36*a* and 37*a* of the respective outfeed conveyors 36 and 37 are constructed as pivotably supported rocker or balance members.

After the winding body or core 2 of a product package 8 has been mounted at the support or supporting structure 29 or 30, as the case may be, the free end of the winding band or tape 6 is guided around the respective guide roll 34 or 35 and led to the respective spool member 31 or 32 and connected therewith. Subsequently, this spool member 31 or 32 and possibly also the guide roll 34 and 35 are driven in a known and therefore not particularly illustrated manner. As a result the winding band or tape 6 is withdrawn from the product package 8 and wound up on the respective spool member 31 or 32 to form a winding band or tape package 33 thereon. During this operation, the imbricated product formation S is paid off or runs off from the product package 8 which rotates in the direction of the arrow D and which is slightly braked as illustrated for the upper unwinding location or terminal 27. The unwound imbricated product formation S is further led away or removed in the direction of the arrow E.

When all printed products 25 have been unwound, the winding body or core 2 is driven in the opposite direction, i.e. in the direction of the arrow F in a not particularly shown manner. The winding band or tape 6 is now unwound from the winding band or tape package 33, which possibly is slightly braked, and wound up on the outer surface 5 of the winding body or core 2 until the entire winding band or tape 6 is wound up on the winding body or core 2. The free end 6*a* of the winding band or tape 6, as heretofore described with reference to FIG. 2, is fixedly held at the outermost complete turn or winding 7. The empty winding body or core 2 conjointly with the winding band or tape 6 wound thereupon, can now be removed and replaced by another product package 8. This empty winding body or core 2 can then be used again for a further winding-up operation of printed products 25.

The winding band or tape 6 is always transported and stored substantially in its entire length conjointly with the winding body or core 2. During such transport or storage the winding band or tape 6 either is wound up in its entire length on the outer surface 5 of the winding body or core 2 or forms with at least part of its length partitioning layers or coils 9 between the layers or coils of the product package 8. Since in either case only the required length of the winding band or tape 6 for forming the product package 8 is unwound from the winding body or core 2, no remainder of the winding band or tape 6 is left on the winding band or tape spool members 17 or 18, as the case may be, after completion of the product package 8. Thus, using one single winding band or tape 6 of a predetermined length, there can be formed product packages 8 requiring different lengths of the winding band or tape 6. This result is obtained without the winding band or tape 6 being required to be cut or any remaining length of the winding band or tape 6 being required to be wound up on the outside of the product package 8 at the end of the product winding-up operation which would entail a loss of time.

The winding bodies or cores 2 described above can be stored or stacked in a space saving manner not only conjointly with the printed products 25 wound thereupon but also in their empty state, i.e. only conjointly with the wound-up winding band or tape 6. Due to their simple construction, the winding bodies or cores 2 can be manufactured and handled in a simple manner.

The winding units 1 are especially suitable for forming product packages 8 having not too large diameters, i.e. diameters of less than 2 meters.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of interim storing of printed products, typically newspapers, periodicals and the like which arrive in an imbricated product formation, said method comprising the steps of:

winding up a predetermined length of at least one winding band on the outer surface of a winding body which is subsequently used for winding up thereupon an imbricated formation of printed products;

arranging a spool member for receiving a predetermined required length of the at least one winding band and in operative association with said winding body;

preparing at said outer surface of said winding body a winding surface for winding up thereupon said imbricated formation of printed products by unwinding said predetermined required length of said at least one winding band from said predetermined length of said at least one winding band wound up upon said outer surface of said winding body;

conjointly with unwinding said predetermined required length of said at least one winding band, winding up said predetermined required length of said at least one winding band on said spool member operatively associated with said winding body;

rotatably driving said winding body in order to wind up for interim storage at said winding surface of said winding body, the arriving imbricated product formation conjointly with said predetermined required length of said at least one winding band; and said step of conjointly winding up said imbricated product formation and said at least one winding band on said winding surface of the winding body, entailing the steps of infeeding said arriving imbricated formation to said winding body and conjointly therewith unwinding said predetermined required length of said at least one winding band in a tensioned state from said spool member and thereby forming a product package for interim storing said printed products.

2. The method as defined in claim 1, further including the step of:

selecting as said winding body having said outer surface for winding up thereupon said imbricated product formation and said at least one winding band, a hollow substantially cylindrical winding body devoid of any winding mechanism disposed in the interior of said hollow, substantially cylindrical winding body.

3. The method as defined in claim 1, wherein:

during said step of winding up said predetermined length of said at least one winding band on said outer surface of said winding body, forming windings of said at least one winding band and which windings are superimposed upon each other on said outer surface of said winding body.

4. The method as defined in claim 1, wherein:

during said step of winding up said predetermined length of said at least one winding band on said outer surface of said winding body, forming windings of said at least one winding band which are offset from each other in the direction of a lengthwise axis of said winding body.

5. The method as defined in claim 4, wherein:

said step of winding up said at least one winding band in said offset windings entails winding said offset windings in a substantially helically shaped configuration.

6. The method as defined in claim 1, further including the step of:

fixedly attaching to said winding body at least one end of said predetermined length of said at least one winding band.

7. A winding arrangement for interim storing of printed products, typically newspapers, periodicals and the like which arrive in an imbricated product formation, comprising:

a winding body for winding up thereupon an imbricated formation of printed products;

said winding body defining an outer surface;

at least one winding band having one end;

said one end of said at least one winding band being fixedly connected to said winding body;

said at least one winding band being wound up on said outer surface of said winding body to form a wound supply of said at least one winding band;

means for unwinding a predetermined required length of the wound supply of the at least one winding band in preparation for winding up the imbricated formation of printed products upon the winding body;

said means for unwinding including a spool for receiving said predetermined required length of said at least one winding band;

means for winding said imbricated product formation conjointly with said predetermined required length of the at least one winding band onto the outer surface of said winding body; and whereby said outer surface of said winding body and any remaining length of the at least one winding band still wound upon said outer surface of the winding body after unwinding said predetermined required length serves for supporting a wound product package formed from the imbricated formation of printed products which has been wound upon the winding body conjointly with said predetermined required length of the wound supply of the at least one winding band.

8. The winding arrangement as defined in claim 7, wherein:

said winding body for winding up thereupon said imbricated formation of printed products and containing said at least one winding band wound up on said outer surface of said winding body, constitutes a hollow, substantially cylindrical winding body devoid of any winding mechanism disposed in the interior of said hollow, substantially cylindrical winding body.

9. The winding arrangement as defined in claim 8, wherein:

said hollow substantially cylindrical winding body possesses a predetermined total length and an inner substantially cylindrical surface; and said inner substantially cylindrical surface extending along said hollow, substantially cylindrical predetermined total length of said winding body.

10. The winding arrangement as defined in claim 8, wherein:

said hollow substantially cylindrical winding body possesses a predetermined effective length; and said hollow substantially cylindrical winding body containing an interior hollow space which extends substantially continuously along said predetermined effective length of said hollow, substantially cylindrical winding body.

11. The winding arrangement as defined in claim 7, wherein:

said at least one winding band is wound up on said outer surface of said winding body in the form of a predetermined number of windings; and said predetermined number of windings are superimposed upon each other.

12. The winding arrangement as defined in claim 7, wherein:

said winding body defines a lengthwise axis;

said at least one winding band being wound up on said outer surface of said winding body in the form of a predetermined number of windings; and said predetermined number of windings being arranged offset from each other in the direction of said lengthwise axis of said winding body.

13. The winding arrangement as defined in claim 12, wherein:

said predetermined number of windings are wound in a substantially helically shaped configuration.

14. The winding arrangement as defined in claim 7, wherein:

said outer surface defines a circumferential direction of said winding body;

said winding body possessing an outwardly open groove extending in said circumferential direction of said winding body; and said at least one wound-up winding band being accommodated in said outwardly open groove of said winding body.

* * * * *

UNITED STATES PATENT AND TRADEMARK OFFICE

CERTIFICATE OF CORRECTION

PATENT NO. : 4,832,273

DATED : May 23, 1989

INVENTOR(S) : WERNER HONEGGER

It is certified that error appears in the above-identified patent and that said Letters Patent is hereby corrected as shown below:

Column 3, line 20, after "a" please insert --product winding-up operation. Further means are provided for--

Column 3, line 22, after "one" please delete "product winding-up" and insert --winding band or tape which is placed under tension and unwound from the aforementioned spool member.--

Column 3, lines 23 to 25, please delete in their entirety.

Column 5, line 17, after "is" please insert --provided with two circumferential ribs 3 and 4 which are--

Column 7, line 14, after "conveyors" please delete "21" and insert --22--

Column 11, line 3, please delete "at least one"

Column 11, line 35, after "said" please delete "hollow, substantially cylindrical"

UNITED STATES PATENT AND TRADEMARK OFFICE

CERTIFICATE OF CORRECTION

PATENT NO. : 4,832,273

DATED : May 23, 1989

INVENTOR(S) : Werner Honegger

It is certified that error appears in the above-identified patent and that said Letters Patent is hereby corrected as shown below:

Column 11, line 36, after "said" insert --hollow, substantially cylindrical--.

Signed and Sealed this

Twenty-seventh Day of March, 1990

*Attest:*

JEFFREY M. SAMUELS

*Attesting Officer*

*Acting Commissioner of Patents and Trademarks*